US005893010A

United States Patent [19]

Nagashima et al.

[11] Patent Number: 5,893,010

[45] Date of Patent: Apr. 6, 1999

[54] TONER DENSITY CONTROLLING METHOD AND APPARATUS

[75] Inventors: Takashi Nagashima; Satoru Yonemoto; Toshinori Nishimura; Ryoji Nishimura; Ikuo Makie, all of Osaka, Japan

[73] Assignee: Mita Industrial Co., Ltd., Osaka, Japan

[21] Appl. No.: 887,904

[22] Filed: Jul. 8, 1997

[30] Foreign Application Priority Data

Jul. 9, 1996 [JP] Japan ..... 8-179089

[51] Int. Cl.[6] ..... G03G 15/10

[52] U.S. Cl. ..... 399/62; 399/63

[58] Field of Search ..... 399/38, 39, 44, 399/53, 58, 60, 61, 62, 63

[56] References Cited

U.S. PATENT DOCUMENTS

| | | | |
|---|---|---|---|
| 5,311,256 | 5/1994 | Hamamichi et al. | 399/44 |
| 5,311,261 | 5/1994 | Nakagama et al. | 399/63 |
| 5,475,476 | 12/1995 | Murai et al. | 399/44 X |

*Primary Examiner*—Arthur T. Grimley
*Assistant Examiner*—Hoan Tran
*Attorney, Agent, or Firm*—Rabin & Champagne, P.C.

[57] ABSTRACT

A toner density controlling apparatus adapted to control toner density by sensing a T/D level in a developer vessel by using a toner sensor performs a toner density controlling operation on the basis of an output of the toner sensor while maintaining an input control voltage to be applied to the toner sensor at a predetermined level in a definite control range where the toner sensor output decreases proportionally to the T/D level in a linear relation. Conversely, in an indefinite control range where the relationship between the toner sensor output and the T/D level is nonlinear, the input control voltage to be applied to the toner sensor is variably controlled so that the toner sensor output can be adjusted to an upper or lower limit level of the definite control range, and the toner density controlling operation is performed on the basis of the input control voltage. With such an arrangement, even if the definite control range where the toner sensor output decreases proportionally to the T/D level in a linear relation is narrow, the toner density controlling operation can be performed on the basis of the input control voltage in the other control ranges. Therefore, even if an image forming apparatus provided with such a toner density controlling apparatus is used in an extensively varied environment, the toner density can properly be controlled by using a single toner sensor.

7 Claims, 6 Drawing Sheets

TONER DENSITY CONTROLLING METHOD AND APPARATUS

This application is based on an application No. 8-179089 filed in Japan, the content of which is incorporated hereinto by reference.

BACKGROUND OF THE INVENTION

1. Field of the Invention

The present invention relates to a toner density controlling method and apparatus for use in an image forming apparatus such as a copying machine or a laser printer. More particularly, the invention relates to a toner density controlling apparatus which uses a two-component developer containing toner and a carrier.

2. Description of Related Art

In a copying machine, for example, image formation is achieved by exposing a uniformly charged photoreceptor surface to light for formation of an electrostatic latent image on the photoreceptor surface, then developing the electrostatic latent image into a visible toner image with toner, and transferring the toner image onto a sheet.

The development of the electrostatic latent image with the toner is achieved by allowing the toner to electrostatically adhere onto the photoreceptor surface by means of a developer unit. As the development operation is repeatedly performed by the developer unit, the amount of the toner retained in a developer vessel of the developer unit is reduced. Where a two-component developer is used, a carrier and a toner are retained in the developer vessel. In such a case, the amount of the toner is reduced during the repeated development operation, while the amount of the carrier is kept constant. Therefore, a T/D level (%) (wherein T is the amount of the toner and D is the amount of the developer (the total amount of the toner and the carrier)) indicative of the proportion of the toner to the developer is changed, resulting in a change in the image density.

To cope with this, it is a conventional practice to determine the change in the T/D level by sensing the magnetic permeability of the developer in the developer vessel by means of a toner sensor. The sensing of the magnetic permeability of the developer is based on the ground that the two-component developer contains a magnetic substance as the carrier and the change in the magnetic permeability is inversely proportional to the amount of the toner with the amount of the carrier kept constant.

Conventionally, the density of the toner in the developer vessel is kept constant by driving a toner feed motor to supply the toner from a hopper to the developer vessel in such a manner that the T/D level is kept constant. More specifically, a target output level of the toner sensor is preliminarily determined such that a desired T/D level can be maintained, and the operation of the toner feed motor is controlled so that the actual output voltage of the toner sensor reaches the target output level.

However, the output of the toner sensor changes with the change in the absolute humidity. Further, the relationship between the output voltage of the toner sensor and the T/D level varies with the input control voltage to be applied to the toner sensor. In addition, the output of the toner sensor decreases proportionally to the T/D level in a definitely linear relation only in a relatively limited range.

Therefore, the output of the toner sensor does not always decrease proportionally to the T/D level under any possible environmental conditions where the copying machine is used. Depending on the use environment of the copying machine, the relationship between the output of the toner sensor and the T/D level may involve uncertainty, so that the image density cannot properly be controlled.

Alternatively, a plurality of toner sensors may be employed, which are switched to cover extensive environmental conditions for correct determination of the T/D level. In such a case, however, the number of toner sensors is increased, so that the control operation of the toner sensors is complicated and the cost of the apparatus is increased.

SUMMARY OF THE INVENTION

It is therefore an object of the present invention to provide a toner density controlling method and apparatus which are capable of properly controlling the toner density under any environmental conditions by correctly determining the T/D level in an extensive use environment by means of a single toner sensor.

It is another object of the present invention to provide a toner density controlling method and apparatus which are capable of properly controlling the toner density in a less expensive manner by means of a single toner sensor.

In accordance with the present invention, a toner density controlling apparatus adapted to control the toner density by sensing the T/D level in a developer vessel by means of a toner sensor performs a toner density controlling operation on the basis of an output of the toner sensor while maintaining an input control voltage to be applied to the toner sensor at a predetermined level in a definite control range where the toner sensor output decreases proportionally to the T/D level in a linear relation. Conversely, in an indefinite control range where the relationship between the toner sensor output and the T/D level is indefinite, the input control voltage to be applied to the toner sensor is variably controlled so that the toner sensor output can be adjusted to an upper or lower limit level of the definite control range, and the toner density controlling operation is performed on the basis of the input control voltage.

With such an arrangement, even if the definite control range where the toner sensor output decreases proportionally to the T/D level in a linear relation is narrow, the toner density controlling operation can be performed on the basis of the input control voltage in the other control ranges.

Therefore, even if an image forming apparatus provided with such a toner density controlling apparatus is used in an extensively varied environment, the toner density can properly be controlled by means of a single toner sensor.

DESCRIPTION OF THE PREFERRED EMBODIMENT

Figure 1:
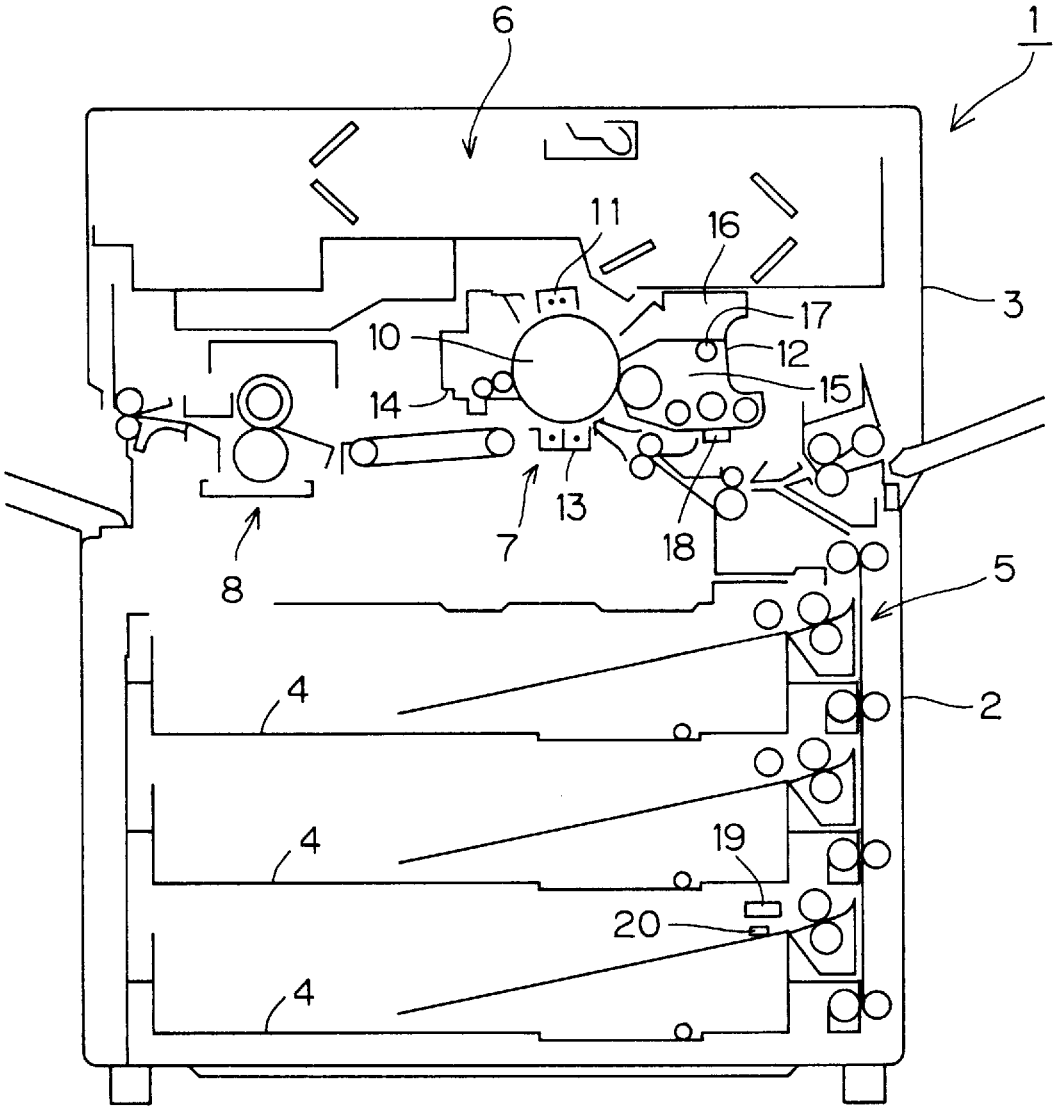
FIG. 1 sectional view schematically illustrating the construction of a copying machine which employs a toner density controlling apparatus according to one embodiment of the present invention.

FIG. 1 is a sectional view schematically illustrating the overall construction of a copying machine which employs a toner density controlling apparatus according to one embodiment of the present invention.

The copying machine 1 includes a sheet retaining device 2 and a body 3 disposed on top of the sheet retaining device 2. The sheet retaining device 2 includes a plurality of cassettes 4 for retaining sheets and a transportation mechanism 5 for taking out sheets one by one from any of the cassettes 4 and feeding them to the body 3. The body 3 includes an optical system 6 for reading a document original, an image formation mechanism 7 for forming an image on the basis of light applied from the optical system 6 and transferring the image on a sheet, and a fixation unit 8 for fixing the transferred image on the sheet.

The image formation mechanism 7 includes a photoreceptor drum 10, a charger 11 for charging the photoreceptor drum 10, a developer unit 12 for developing an electrostatic latent image formed on the photoreceptor drum 10 into a toner image, a transfer/separation charger 13 for transferring the toner image onto a sheet from the photoreceptor drum 10 and separating the sheet from the photoreceptor drum 10, and a cleaner 14 for cleaning residual toner on the photoreceptor drum 10.

In the developer unit 12, an electrostatic image formed on the photoreceptor drum 10 is developed into a toner image with a two-component developer containing a toner and a carrier. The developer unit 12 includes a developer vessel 15, a hopper 16 for retaining the toner to be supplied into the developer vessel 15, and a feed roller 17 which is driven to supply the toner into the developer vessel 15 from the hopper 16. A toner sensor 18 for sensing the magnetic permeability of the developer (containing the toner and the carrier) in the developer vessel 15 is disposed in association with the developer vessel 15.

The copying machine 1 further includes a humidity sensor 19 and a temperature sensor 20 for sensing the ambient humidity and temperature, respectively, around the copying machine 1. Although the humidity sensor 19 and the temperature sensor 20 are provided in association with the sheet retaining device 2 in this embodiment, these sensors may be provided in any positions in the copying machine 1. The positions of these sensors are not critical, as long as the sensors can sense the ambient humidity and temperature in the use environment of the copying machine 1, particularly in the use environment of the developer unit 12.

Figure 2:
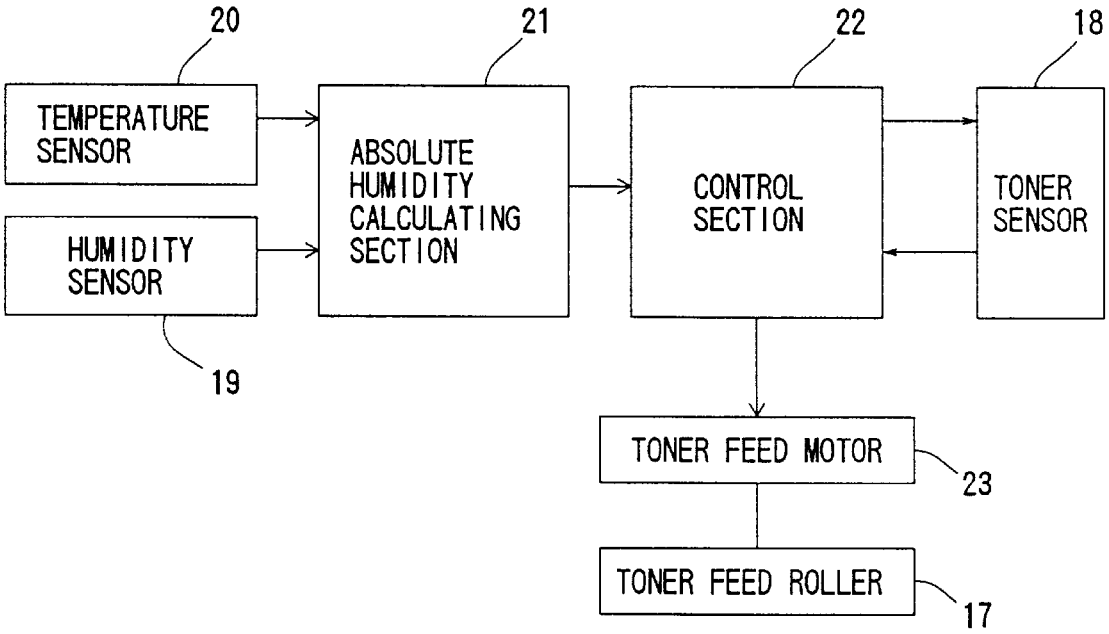
FIG. 2. is a block diagram schematically illustrating the construction of the toner density controlling apparatus according to the embodiment of the present invention.

FIG. 2 is a block diagram schematically illustrating the construction of the toner density controlling apparatus provided in the copying machine 1 shown in FIG. 1.

Referring to FIG. 2, the ambient temperature and relative humidity around the copying machine 1 are measured by means of the temperature sensor 20 and the humidity sensor 19, respectively. Outputs of the temperature sensor 20 and the humidity sensor 19 are applied to an absolute humidity calculating section 21. The absolute humidity calculating section 21 calculates the ambient absolute humidity around the copying machine 1, i.e., around the developer unit 12, on the basis of the temperature and the relative humidity measured by the respective sensors. The calculated absolute humidity is applied to a control section 22. The control section 22 determines a control target output level of the toner sensor 18 corresponding to a control target T/D level on the basis of the calculated absolute humidity, and controls a toner feed motor 23 so as to maintain the output of the toner sensor at the control target output level. Upon actuation of the toner feed motor 23, the feed roller 17 is driven to feed the toner into the developer vessel 15 from the hopper 16.

The characteristics of the toner sensor 18 will next be described.

Figure 3:
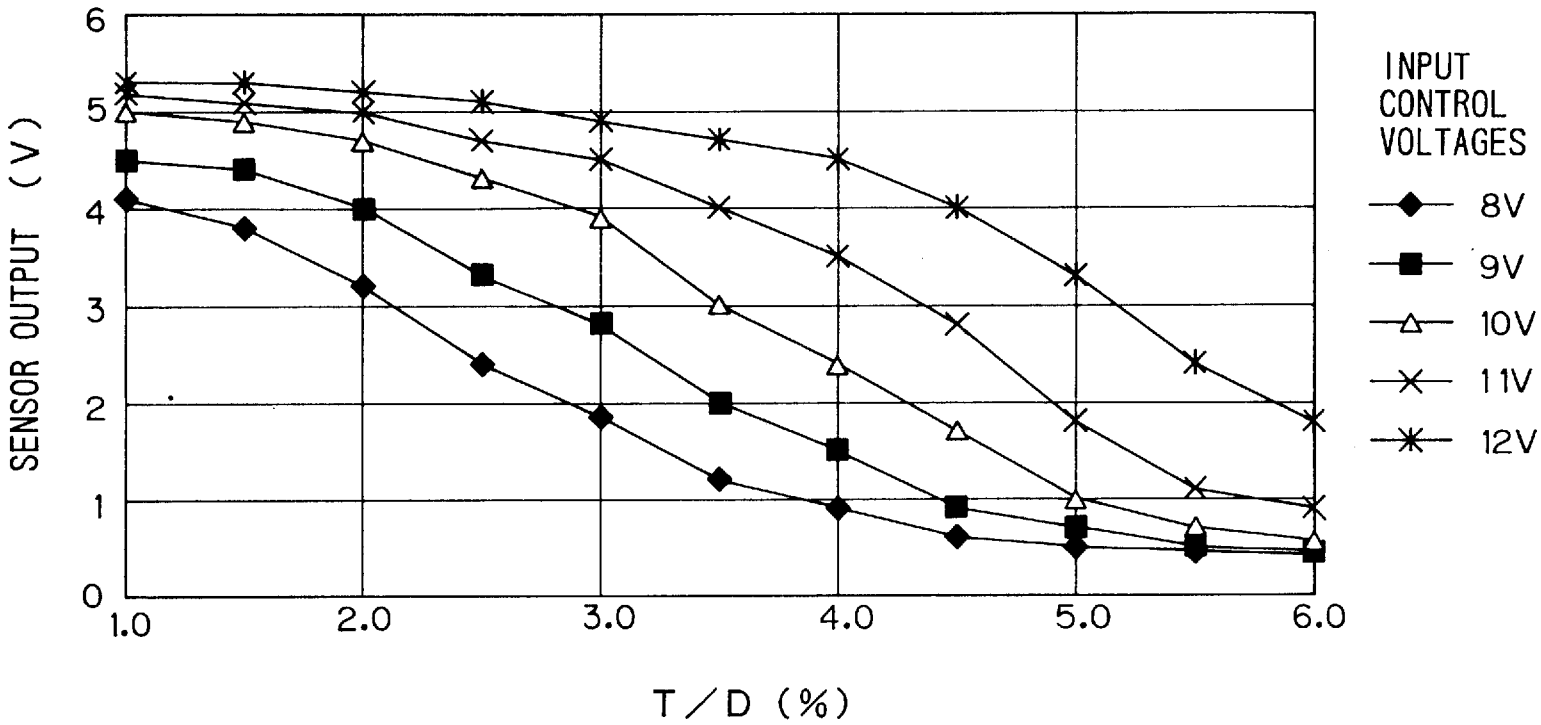
FIG. 3 is a graph illustrating the relationship of the T/D level versus the output voltage of a toner sensor employed in the embodiment of the present invention.

FIG. 3 is a graph illustrating the characteristics of the toner sensor 18 employed in the embodiment of the present invention, in which the T/D level (%) and the sensor output voltage (V) are plotted as the abscissa and the ordinate, respectively. In the toner sensor 18, the relationship between the T/D level and the output voltage is changed by setting the input control voltage at different levels. Therefore, the input control voltage is usually set at a predetermined level so that the sensor output decreases proportionally to the T/D level in a linear relation in a specific range.

Referring to the graph of FIG. 3, the slopes of the curves showing the relationship between the T/D level and the sensor output are small in sensor output voltage ranges of lower than about 1.0 V and higher than about 3.5 V with input control voltages of 8 V to 12 V. This means that the output voltage does not significantly change with the change in the T/D level in these sensor voltage ranges (lower than about 1.0 V and higher than about 3.5 V).

On the other hand, the graph of FIG. 3 indicates that the sensor output voltage decreases proportionally to the T/D level in a definitely linear relation in a sensor output voltage range from about 1.0 V to about 3.5 V with input control voltages of 8 V to 12 V.

In this embodiment, the toner density is controlled on the basis of a change in the output voltage with the input control voltage kept at a predetermined level (e.g., 10 V) in a sensor output voltage range from 1.5 V to 3.0 V which is determined by allowing a predetermined margin for the aforesaid upper and lower limit values of the sensor output voltage.

In sensor output voltage ranges of lower than 1.5 V or higher than 3.0 V, the input control voltage is variably controlled so that the sensor output voltage can be adjusted to the limit value (1.5 V or 3.0 V). An input control voltage level obtained at this time is used for the toner density control.

Figure 4:
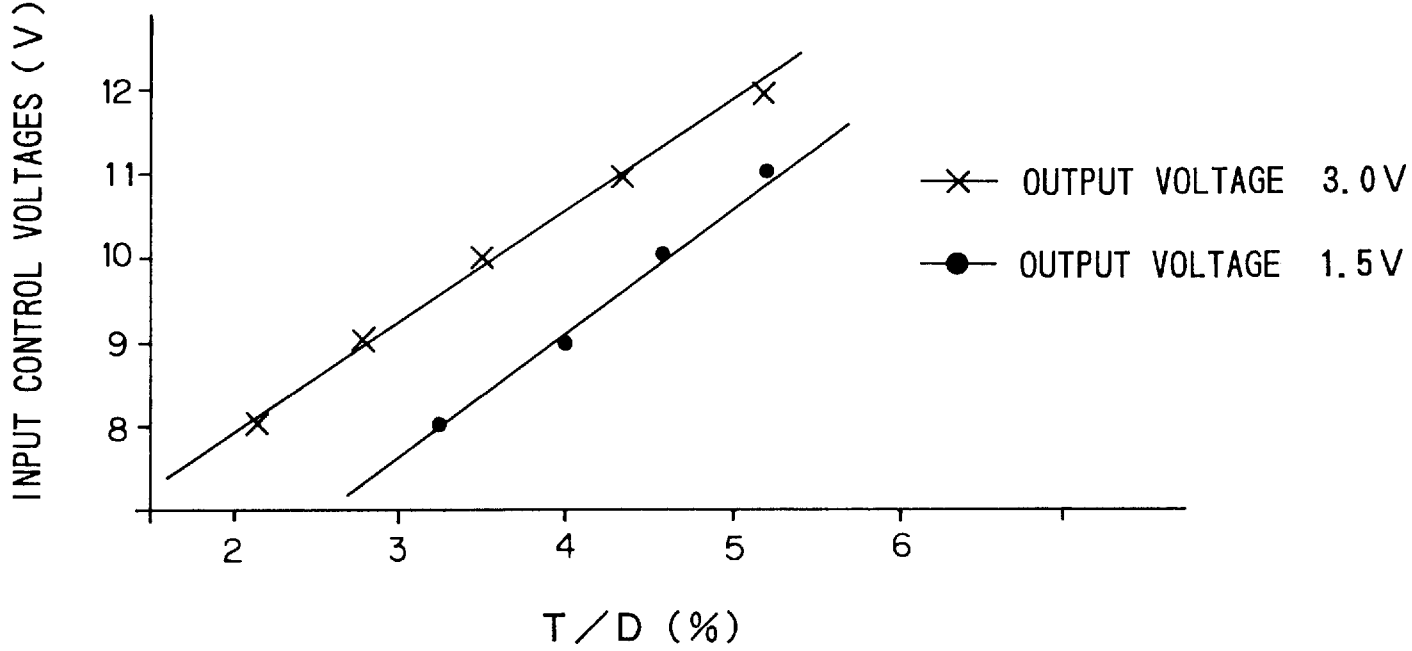
FIG. 4 is a graph illustrating the relationship of the T/D level versus the input control voltage of the toner sensor which is obtained from the graph of FIG. 3.

FIG. 4 is a graph illustrating the relationship of the T/D level versus the input control voltage which is plotted on the basis of the data obtained at sensor output voltages of 1.5 V and 3.0 V in the graph of FIG. 3. In FIG. 4, the T/D level and the input control voltage are plotted as the abscissa and the ordinate, respectively. As is apparent from FIG. 4, the input control voltage is linearly proportional to the T/D level when the input control voltage is varied to adjust the sensor output voltage at 1.5 V or 3.0 V.

This means that, if the output voltage of the toner sensor 18 is less than 1.5 V or higher than 3.0 V, the input control voltage is variably controlled so that the output voltage can be fixed at the limit value (1.5 V or 3.0 V) and an input control voltage level obtained at this time is employed as a control value for the toner density control. Thus, the toner density control can properly be performed throughout a possible T/D variation range.

In other words, the toner density control is performed on the basis of the output voltage of the toner sensor with the input control voltage to the toner sensor maintained at a predetermined level in a definite control range where the output voltage of the toner sensor decreases proportionally to the T/D level in a linear relation. Conversely, in an indefinite control range where the toner sensor output voltage changes only a little even with a large change in the T/D level, the input control voltage is variably controlled so that the toner sensor output can be adjusted to a predetermined level, and the toner density control is performed on the basis of the input control voltage. Thus, the toner density control can be performed both in the definite control range and in the indefinite control range.

Figure 5:
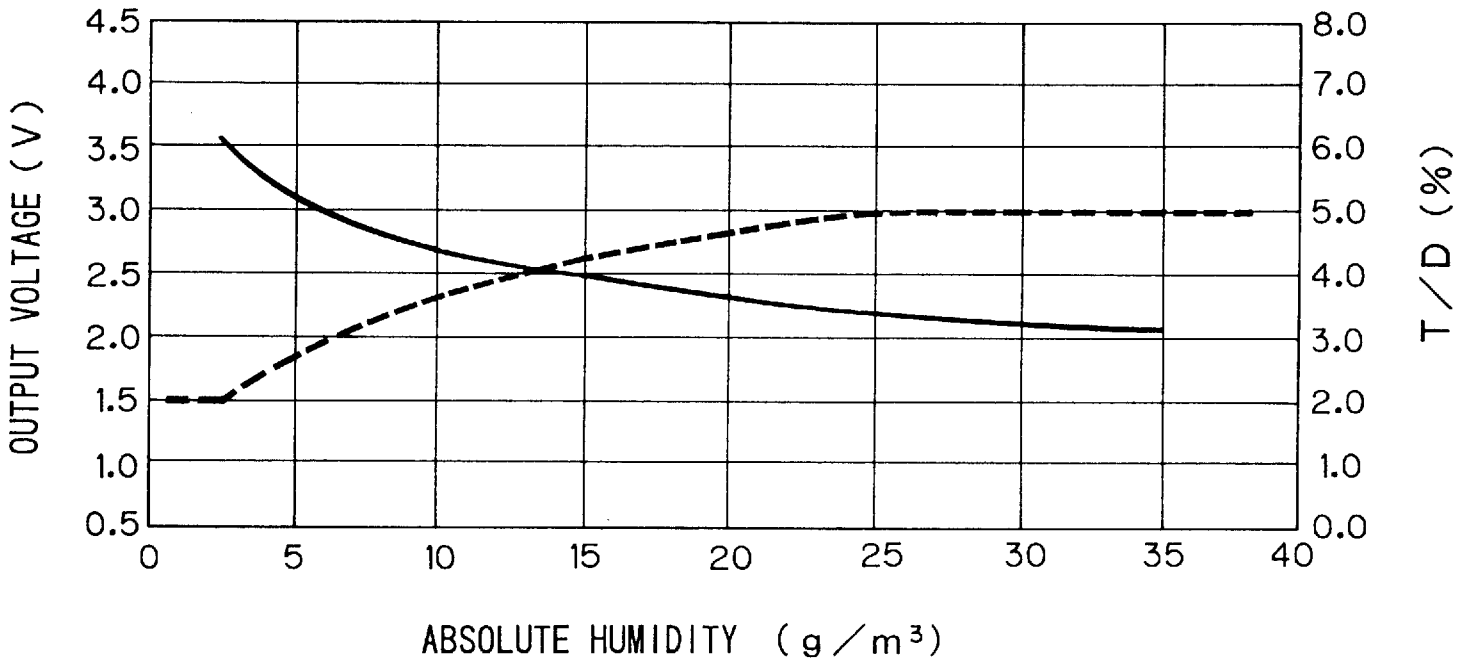
FIG. 5 is a graph illustrating the relationship of the the output voltage of the toner sensor providing for a proper image density versus the absolute humidity and the relationship of the T/D level providing for a proper image density versus the absolute humidity.

FIG. 5 is a graph illustrating the relationship of the T/D level versus the absolute humidity and the relationship of the output voltage of the toner sensor versus the absolute humidity.

Referring to FIG. 5, the relationship between the absolute humidity and the T/D level providing for a proper image density is shown by a solid line. More specifically, when the absolute humidity is low, the charge of the toner being stirred in the developer vessel 15 (see FIG. 1) is increased. Therefore, the amount of the toner adhering onto the photoreceptor drum 10 tends to be reduced, so that the resulting image density is reduced. This is because the charge per a toner particle is increased and the charge of the photoreceptor drum 10 is neutralized with a relatively small number of toner particles. Therefore, the T/D level should be increased as the absolute humidity becomes lower.

To obtain a proper image density at a varied absolute humidity, the T/D level should be variably controlled depending on the absolute humidity. On the other hand, the output voltage of the toner sensor decreases proportionally to the T/D level as described above. Therefore, the toner density control can properly be performed simply by changing the output voltage of the toner sensor in accordance with the change in the absolute humidity as indicated by a broken line in FIG. 5.

In this case, the toner sensor 18 used in this embodiment is characterized in that the sensor output voltage decreases proportionally to the T/D level in a linear relation in a sensor output voltage range from 1.5 V to 3.0 V (in the definite control range) while the sensor output voltage changes a little with the change in the T/D level in the other sensor output voltage ranges (in the indefinite control range). As described above, the input control voltage is controlled so that the output voltage of the toner sensor 18 is fixed at 1.5 V or 3.0 V.

If the toner sensor is actually operated to check whether the output voltage of the toner sensor 18 falls within the definite control range or within the indefinite control range, the toner density control cannot smoothly be performed. In this embodiment, it is determined, on the basis of the absolute humidity obtained from the measurement, whether the toner density control is to be based on the output voltage of the toner sensor 18 or on the input control voltage. That is, the toner density control is switched between these two controlling methods, depending on the absolute humidity.

More specifically, the toner sensor output voltage range from 1.5 V to 3.0 V corresponds to an absolute humidity range from 2.5 to 24.0 (g/m$^3$) in FIG. 5. Whether the toner density control is based on the output voltage of the toner sensor 18 or on the input control voltage to be applied to the toner sensor 18 is determined on the basis of a judgment of whether or not the absolute humidity calculated by the absolute humidity calculating section 21 shown in FIG. 2 falls within the aforesaid range.

The control section 22 determines the method of controlling the toner sensor 18 on the basis of the absolute humidity calculated by the absolute humidity calculating section 21. The relationship between the T/D level and the absolute humidity obtained from the graph of FIG. 5 for proper image formation is preliminarily stored in the control section 22. Therefore, the control section 22 determines a T/D level required for proper image formation at the calculated absolute humidity, and controls the toner feed motor 23 so that the required T/D level is attained. The resultant T/D level is sensed by the toner sensor 18 and applied in the form of an output voltage or an input control voltage to the control section 22. Thus, the feed back control of the toner feed motor 23 is performed on the basis of the output voltage of the toner sensor 18 applied thereto or the input control voltage to be applied to the toner sensor 18.

Figure 6:
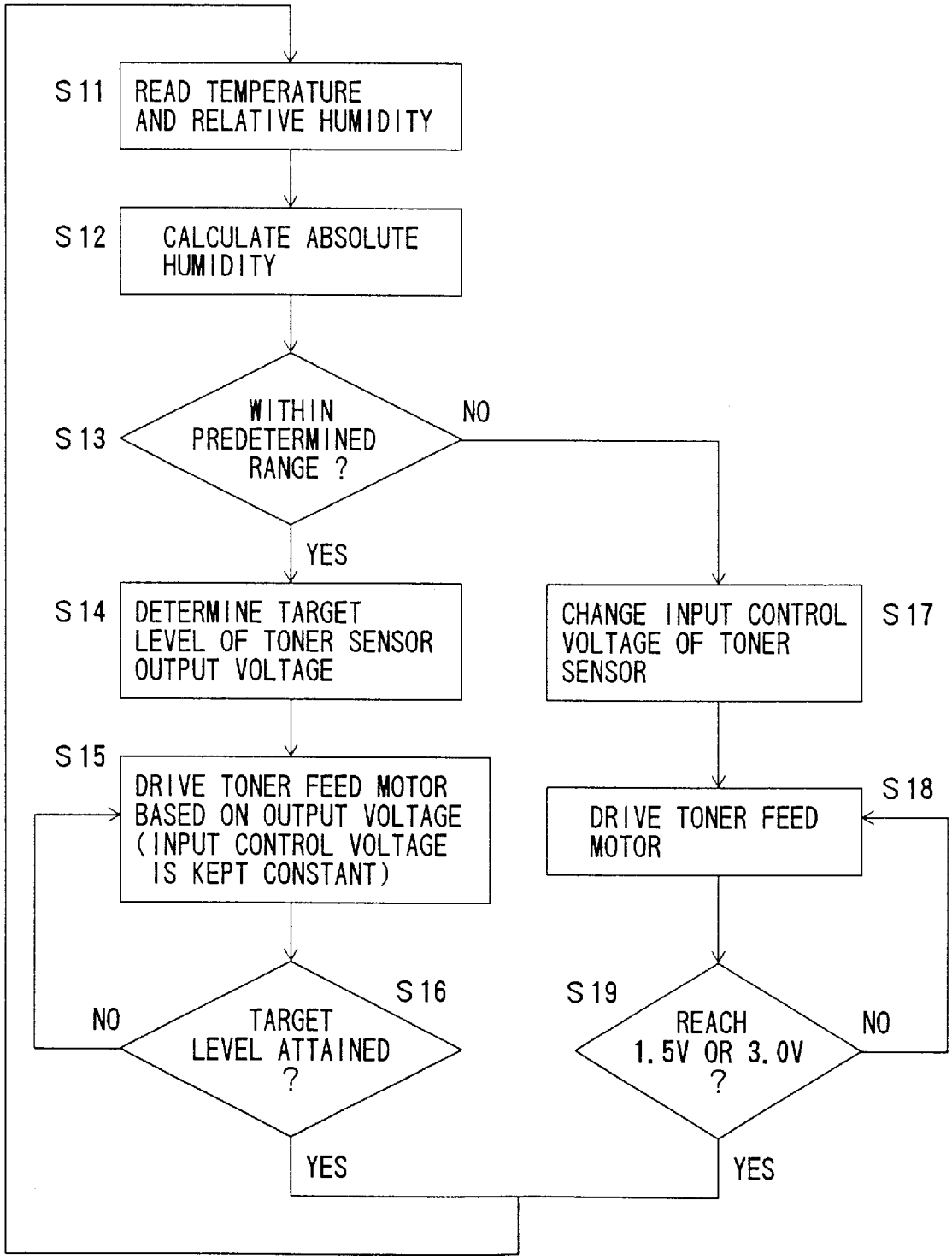
FIG. 6 is a flow chart illustrating a control process to be performed by the toner density controlling apparatus according to the embodiment of the present invention.

FIG. 6 is a flow chart illustrating a toner density control process to be performed by the control section 22 shown in the block diagram of FIG. 2. With reference to FIG. 6, the control operation will next be explained.

First, the ambient temperature and relative humidity around the copying machine 1 are measured by means of the temperature sensor 20 and the humidity sensor 19, respectively (Step S11). The absolute humidity is calculated on the basis of the measured temperature and relative humidity by the absolute humidity calculating section 21 (Step S12). The control section 22 determines whether or not the calculated absolute humidity falls within the predetermined range (i.e., 2.5 to 24.0 g/m$^3$) (Step S13). If the absolute humidity falls within the predetermined range, the control process is performed in accordance with Steps S14 to S16. Conversely, if the absolute humidity falls out of the predetermined range, the control process is performed in accordance with Steps S17 to S19.

More specifically, if the absolute humidity calculated by the absolute humidity calculating section 21 falls within the predetermined range, a target T/D level is determined on the basis of the relationship of the absolute humidity versus the T/D level shown in FIG. 5, and a target level of the toner sensor output voltage for the target T/D level is determined (Step S14). Then, the toner feed motor 23 is driven on the basis of the output voltage of the toner sensor 18 with the input control voltage of the toner sensor 18 kept at a predetermined level (e.g., 10 V) (Step S15). More specifically, if a current output voltage of the toner sensor 18 exceeds the target level, the toner feed motor is driven to supply the toner into the developer vessel 15 from the hopper 16. The toner feed motor 23 is kept driven until the output voltage of the toner sensor 18 reaches the target level (Steps S15 and S16). When the output voltage of the toner sensor 18 reaches the target level, the driving of the toner feed motor 23 is stopped, and the process sequence from Step S11 is repeated.

If it is determined in Step S13 that the calculated absolute humidity falls out of the predetermined range, a T/D level corresponding to the the calculated absolute humidity is determined on the basis of the graph shown in FIG. 5, and a level of the input control voltage of the toner sensor 18 corresponding to the T/D level is determined on the basis of graph shown in FIG. 4. Then, the input control voltage is changed to the determined level (Step S17). After that, the toner feed motor 23 is driven until the output control voltage reaches 1.5 V or 3.0 V (Step S18). That is, if a current output voltage of the toner sensor 18 is higher than 1.5 V or 3.0 V on the condition where the input control voltage has been changed, the toner feed motor 23 is driven to supply the toner into the developer vessel 15 from the hopper 16 (Steps S18 to S19). When the output control voltage reaches 1.5 V or 3.0 V, the driving of the toner feed motor 23 is stopped, and the process sequence from Step S11 is repeated.

Although a specific toner sensor is taken as an example and specific absolute humidity levels are employed for judgment on the switching between the two controlling methods in the embodiment described above, the absolute humidity levels are properly determined depending on a toner sensor to be employed.

Further, data indicative of the relationship of the T/D level versus the output voltage of the toner sensor are preliminarily obtained and verified for each toner sensor to be employed, and the relational data thus verified are used for the toner density control.

Although the absolute humidity calculating section 21 and the control section 22 are shown as belonging to different blocks in FIG. 2 in the embodiment described above, these may be constructed as a single element which is incorporated, for example, in a microprocessor.

Alternatively, a control circuit for the toner density control including the absolute humidity calculating section 21 and the control section 22 may be incorporated in a microprocessor for controlling the overall copying machine.

What is claimed is:

1. A toner density controlling method for use in a toner density controlling apparatus adapted to control a toner density by sensing a T/D level indicative of a proportion of a toner (T) in a developer (D) including the toner and a carrier in a developer vessel by means of a toner sensor, the toner density controlling method comprising:

controlling the toner density on the basis of an output of the toner sensor while maintaining an input control signal to be applied to the toner sensor at a predetermined level in a definite control range, when the toner sensor output and the T/D level have a predetermined relationship; and variably controlling the input control signal to be applied to the toner sensor so that the toner sensor output can be adjusted to an upper limit level or a lower limit level of the definite control range, and controlling the toner density on the basis of the input control signal in an indefinite control range when the toner sensor output and the T/D level do not have the predetermined relationship.

2. A toner density controlling method as set forth in claim 1, wherein selection of either the definite control range or the indefinite control range is based on an ambient absolute humidity around the toner density controlling apparatus.

3. A toner density controlling apparatus, comprising:

a developer unit including a developer vessel for retaining a two-component developer including a toner and a carrier;

a single toner sensor for sensing a T/D level indicative of a proportion of the toner (T) in the developer (D) in the developer unit;

absolute humidity measuring means for measuring an ambient absolute humidity around the developer unit;

first controlling means for controlling the T/D level in the developer vessel on the basis of an output signal from the toner sensor while maintaining an input control signal to be applied to the toner sensor at a first predetermined level, if the measured absolute humidity falls within a predetermined range; and second controlling means for variably controlling the input control signal to be applied to the toner sensor so that the output of the toner sensor can be adjusted to a second predetermined level and controlling the T/D level in the developer vessel on the basis of the input control signal, if the measured absolute humidity falls out of the predetermined range.

4. A toner density controlling apparatus as set forth in claim 3, wherein the predetermined range is an absolute humidity range corresponding to a range where the T/D level and the toner sensor output have a predetermined linearly proportional relationship which is obtained by comparing relationships among the absolute humidity, the T/D level and the toner sensor output with each other.

5. A toner density control method for controlling a toner density based on a T/D level sensed by a toner sensor indicative of the proportion of a toner (T) in a developer (D) in a developer vessel, the toner density control method comprising:

controlling the toner density so that the toner sensor generates a target output value corresponding to a target T/D level while maintaining an input control signal to be applied to the toner sensor at a predetermined level, if the target TID level is within a definite control range in which the toner sensor output changes at a rate greater than a threshold rate as the T/D level changes; and variably controlling the input control signal so that the toner sensor generates a predetermined fixed value within the definite control range at the target T/D level, and controlling the toner density so that the toner sensor generates the predetermined fixed value, if a target T/D level is outside the definite control range.

6. A toner density control method according to claim 5, wherein determination of whether the target T/D level is within the definite control range is based on an ambient humidity around the toner density control apparatus.

7. A toner density control apparatus, comprising:

a developer unit including a developer vessel for containing a two-component developer including a toner and a carrier;

a toner sensor for sensing a T/D level indicative of the proportion of the toner (T) in the developer (D) in the developer unit;

humidity sensing means for sensing a humidity around the developer unit;

first controlling means for controlling the T/D level in the developer vessel so that the toner sensor generates a target output value corresponding to a target T/D level while maintaining an input control signal to be applied to the toner sensor at a predetermined level, if the sensed humidity falls within a predetermined range wherein the target T/D level is to be set within a definite control range in which the toner sensor output changes at a rate greater than a threshold rate as the T/D level changes; and second controlling means for variably controlling the input control signal so that the toner sensor generates a predetermined fixed value within the definite control range at the target T/D level, and controlling the T/D level so that the toner sensor generates the predetermined fixed value, if the sensed humidity falls outside the predetermined range.

* * * * *